US005197639A

United States Patent [19]

Jerman et al.

[11] Patent Number: 5,197,639

[45] Date of Patent: Mar. 30, 1993

[54] SLIP-FREE GARMENT HANGER WITH FABRIC STRAPS

[76] Inventors: Rafael Jerman; Vivian L. Ruiz, both of 235 SW. Le Jeune Rd., Miami, Fla. 33134

[21] Appl. No.: 780,069

[22] Filed: Oct. 21, 1991

[51] Int. Cl.[5] ..... A47G 25/30; A47G 25/14

[52] U.S. Cl. ..... 223/88; 223/85; 223/86; 223/98

[58] Field of Search ..... 223/88, 91, 85, 86, 223/98, 92, 93; 211/113; D6/315, 318

[56] References Cited

U.S. PATENT DOCUMENTS

| | | | |
|---|---|---|---|
| 845,068 | 2/1907 | Fellows | 223/85 X |
| 1,743,950 | 1/1930 | Amores . | |
| 2,891,705 | 6/1959 | Gray | 223/88 |
| 2,898,024 | 8/1959 | Jenson | 223/91 |
| 2,913,158 | 4/1959 | Reller et al. . | |
| 3,334,736 | 8/1967 | Cole et al. | 223/85 X |
| 3,347,428 | 10/1967 | Gauthier | 223/98 |
| 4,274,564 | 3/1979 | Warmath . | |
| 4,714,156 | 12/1987 | Koltow et al. | 223/85 X |
| 5,020,704 | 6/1991 | Kent | 223/85 |
| 5,022,571 | 6/1991 | Blanchard | 223/85 X |
| 5,056,694 | 10/1991 | Michalik | 223/86 |

FOREIGN PATENT DOCUMENTS

| | | | |
|---|---|---|---|
| 1216758 | 12/1959 | France | 223/86 |
| 923293 | 4/1963 | United Kingdom | 223/85 |

*Primary Examiner*—Werner H. Schroeder
*Assistant Examiner*—Bibhu Mohanty
*Attorney, Agent, or Firm*—Jesus Sanchelima

[57] ABSTRACT

A hanger having an elongated arcuate body defining two arms and a hook member rigidly attached to its center. Upper and lower supporting straps are provided as well as loops for removably receiving built-in clip members for holding garments. The supporting straps are provided with Velcro TM pad terminations and cooperatively mating counterparts rigidly secured to the underside and upperside of the body of the hanger. Aromatic or scented material is contained within a fabric covering the body of the hanger.

8 Claims, 1 Drawing Sheet

SLIP-FREE GARMENT HANGER WITH FABRIC STRAPS

BACKGROUND OF THE INVENTION

1. Field of the Invention

The present invention relates to garment hangers.

2. Description of the Related Art

Garment hangers have been used for a long time and many designs have been conceived in the past. One of the hangers is disclosed in the U.S. Pat. No. 1,743,950 issued to R. M. Amores in 1930. Amores' hanger includes retaining members 12 which are pivotally mounted at 13 and is secured with securing member 14 or snap fastener 14' in place. This bulky design, however, adds considerable weight to the hanger while at the same time it is difficult to operate. In addition, the garment can easily get caught with securing member 14 damaging the piece. This is specially true with delicate garments like lingerie. Finally, the patented device is not capable of holding pants or panties.

Another hanger design is disclosed in U.S. Pat. No. 4,274,564 issued to Warmath in 1981. Flexible hinge 26 is connected to arm 24 thereby closing cavity 28 in a substantially reduced space and fixed location thereby limiting its usefulness accordingly.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a light weight hanger that effectively and readily secures the garment pieces, especially, lingerie pieces.

Another object of the invention is to provide an attractive and scented hanger.

It is another object of this invention to provide an appealing hanger that permits the flexibility of using the entire length of the hangers' arm.

It is still another object of the present invention to provide a hanger capable of holding more than one piece of garment.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
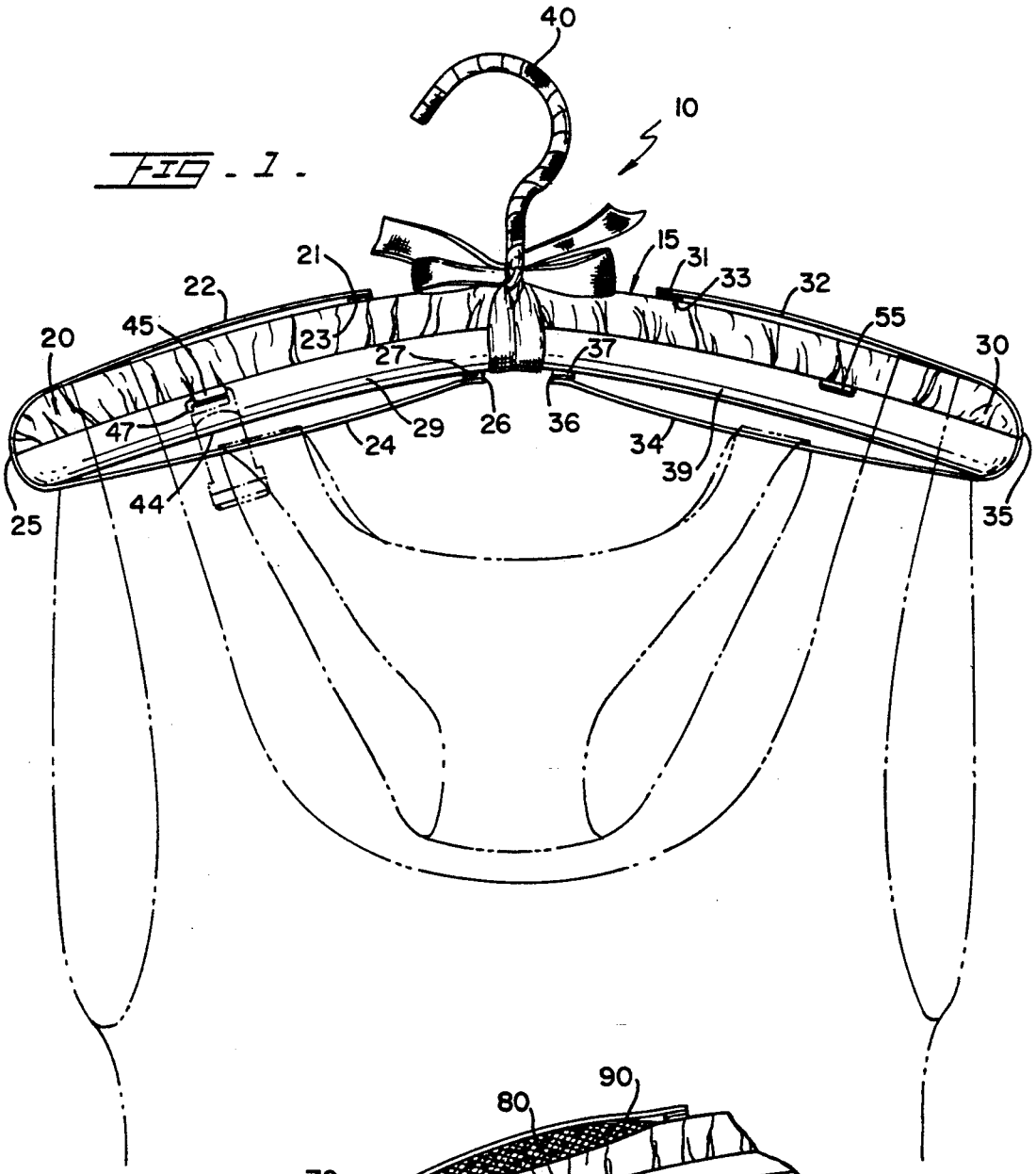
FIG. 1 shows the hanger incorporating the teachings of the present invention with the representation of the typical garment pieces in phantom.

Referring now to FIG. 1, where the present invention is generally referred to with numeral 10, it can be observed that it basically includes an arched elongated body 15 defining two arms, 20 and 30, and hook member 40, upper fastening strap members 22 and 32 and lower fastening strap members 24 and 34 mounted to the upper and lower surfaces of arched elongated body 15, respectively. Additionally clip members 44 are removably mounted to loop 45 securely mounted to front surfaces 29 and 39 of body 15.

In the preferred embodiment, body 15 is covered with suitable fabric to prevent damage to delicate garment pieces. Strap members 24 and 34 are preferably made out of a fabric material or other suitable flexible material. Members 22 and 24 are secured to arm 20, at 25, in the preferred embodiment. Similarly, members 32 and 34 are secured at 35. In the preferred embodiment, members 22 and 24 are implemented with one continuous piece of material. The same can be done for members 32 and 34. The unsecured ends of strap members 22; 24; 32 and 34 are provided with respective Velcro (trademark) pads 21; 26; 31 and 36 that are removably mounted to Velcro (trademark) pads 23; 27; 33 and 37. Velcro (trademark) pads 23; 27; 33 and 37 are secured to upper and lower surfaces of arms 20 and 30. Velcro is a trademark of E. I. Dupont de Nemours and identifies detachable pads having male and female hooks.

Figure 2:
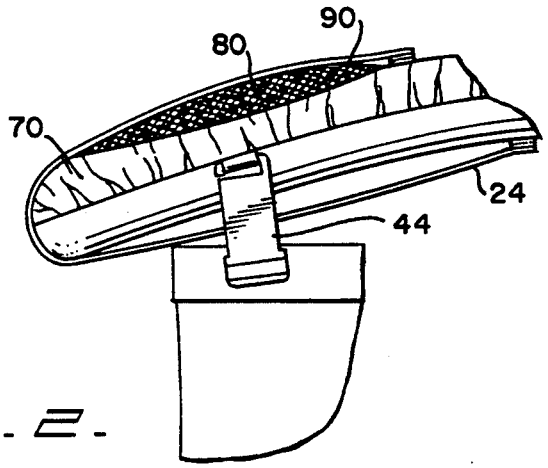
FIG. 2 represents a partial view of the hanger shown in FIG. 1 including a representation of a garment piece being held by the clip member and a compartment for the scented material.

FIG. 2 shows an alternate embodiment where a flexible sheet 70 wrap members 22 and 24 and a meshed material, such as tulle, is used to create blisters or cavities 80 that are filled with solid scented materials 90 such as sachet articles. In this manner the scent easily goes through the meshed material.

Clip member 44 is removably mounted to loop 45. Clip member 44 includes a clip hook 47. Loop 55 is shown without a clip member attached. Clip hook 47 is cooperatively received by loop 45. This is particularly useful when the clip members are not needed. The user has the option of utilizing clip member 44 selectively depending on the garment to be hung.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A garment hanger, comprising:

A. an elongated body member having two ends defining two arms each having an underside and an upperside;

B. hook means centrally mounted to said elongated body member;

C. two flexible first fabric strap means for securing said garment each having two ends and one of said ends of each of said first strap members being mounted substantially adjacent to one of said elongated body member ends; and D. two first means for removably attaching the other ends of said first strap members to the uppersides of said arms at points substantially adjacent to said hook means.

2. The hanger set forth in claim 1 further including:

E. two flexible second strap means for securing said garment each having two ends and one of said ends of said second strap members being mounted substantially adjacent to one of said elongated body member ends; and F. two second means for removably attaching the other ends of said second strap members to the underside of said arms at points substantially adjacent to the center of said elongated body member.

3. The hanger set forth in claim 2 further including:

G. clip members for holding said garment removably mounted to said elongated body member.

4. The hanger set forth in claim 3 wherein said elongated body member includes an outer flexible sheet of fabric covering said body member and including a flexible meshed sheet defining blister cavities and further including scented means within said blister cavities.

5. The hanger set forth in claim 4 wherein said first and second means for removably attaching to other ends of said first and second strap members include mating and cooperating pairs of hook pads.

6. The hanger set forth in claim 5 wherein said clip members include clip hook members and said fabric covering including loop members for cooperatively receiving said clip hook members.

7. The hanger set forth in claim 6 wherein said first and second strap members are formed continuously from one piece.

8. The hanger set forth in claim 7 wherein said flexible meshed material is made out of tulle.

* * * * *